US006712437B2

(12) United States Patent
Furukawa et al.

(10) Patent No.: US 6,712,437 B2
(45) Date of Patent: Mar. 30, 2004

(54) PRINTHEAD BOARD, PRINTHEAD AND PRINTING APPARATUS

(75) Inventors: Tatsuo Furukawa, Kanagawa (JP); Yoshiyuki Imanaka, Kanagawa (JP); Nobuyuki Hirayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/160,008

(22) Filed: Jun. 4, 2002

(65) Prior Publication Data

US 2002/0191037 A1 Dec. 19, 2002

(30) Foreign Application Priority Data

Jun. 15, 2001 (JP) ..... 2001-182525

(51) Int. Cl.[7] ..... B41J 2/195; B41J 29/393; B41J 29/38

(52) U.S. Cl. ..... 347/5; 347/19; 347/9

(58) Field of Search ..... 347/5, 19, 14, 347/23, 12, 10, 11, 9, 50, 59, 20, 15; 399/24, 25; 358/1.1; 400/37

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,608,577 A | | 8/1986 | Hori | 346/140 R |
| 4,723,129 A | | 2/1988 | Endo et al. | 346/1.1 |
| 4,740,796 A | | 4/1988 | Endo et al. | 346/1.1 |
| 5,532,901 A | * | 7/1996 | Hawkins et al. | 347/59 |
| 5,847,576 A | | 12/1998 | Mastrocola et al. | |
| 6,043,679 A | | 3/2000 | Kwon | |
| 6,290,334 B1 | | 9/2001 | Ishinaga et al. | 347/9 |
| 6,302,504 B1 | | 10/2001 | Imanaka et al. | 347/9 |

FOREIGN PATENT DOCUMENTS

| | | |
|---|---|---|
| EP | 0 816 082 A | 1/1998 |
| JP | 54-56847 | 5/1979 |
| JP | 59-123670 | 7/1984 |
| JP | 59-138461 | 8/1984 |
| JP | 60-71260 | 4/1985 |
| JP | 5-185594 | 7/1993 |

OTHER PUBLICATIONS

Patent Abstracts of Japan, vol. 1995, No. 11, Dec. 26, 1995, (JP 07–0231253, Aug. 29, 1995).

* cited by examiner

*Primary Examiner*—Stephen D. Meier
*Assistant Examiner*—Charles W. Stewart, Jr.
(74) *Attorney, Agent, or Firm*—Fitzpatrick, Cella, Harper & Scinto

(57) ABSTRACT

The gate-width ratio between an NMOS transistor (1) and PMOS transistors (2, 3) constructing an initial inverter stage of a voltage converting circuit is set in such a manner that the threshold voltage of the initial inverter becomes a voltage at which an inversion is possible, this voltage being less than one-half the power-supply voltage (VHT) of the voltage converting circuit and, moreover, less than the power-supply voltage (Vdd) of a logic circuit.

21 Claims, 9 Drawing Sheets

PRINTHEAD BOARD, PRINTHEAD AND PRINTING APPARATUS

FIELD OF THE INVENTION

This invention relates to a board for an ink-jet printhead, the printhead per se and a printing apparatus.

BACKGROUND OF THE INVENTION

An electrothermal transducer and (heater) and its drive circuit, which are mounted on a printing apparatus in accordance with the conventional ink-jet method, are formed on the same substrate using semiconductor process technology, as illustrated in the specification of Japanese Patent Application Laid-Open No. 5-185594, by way of example.

Heater and the heater drive circuits are formed integrally on the conventional printhead substrate about nozzles that eject ink. FIG. 6 illustrates an example of the substrate layout.

FIG. 7A exemplifies a specific equivalent circuit corresponding to one segment of a portion in which heaters and driver transistors are disposed in the form of an array.

As shown in FIG. 7A, a heater drive signal possesses an amplitude equivalent to the power-supply voltage of a logic circuit. The signal is boosted by a voltage converting circuit and applied to the gate of the driver transistor to drive the heater. The voltage is boosted because driving the gate of the driver transistor by a high voltage lowers the ON resistance of the transistor.

The above will be described in detail with reference to FIG. 7B. The power-supply voltage Vdd of an ordinary logic circuit is 5V, and the voltage obtained by boosting via the voltage converting circuit, namely the gate voltage applied to the gate of the driver transistor, is set to 8V. Accordingly, by setting the threshold voltage of an inverter A, which is provided as the initial stage of the voltage converting circuit, to the vicinity of 3 to 4V, the initial inverter A is capable of performing an inversion satisfactorily at the amplitude of the power-supply voltage of the logic circuit.

FIG. 9 is a diagram showing the layout of the ordinary inverter according to the prior art. Here the ratio of the gate width (W) of a PMOS transistor to the gate width of an NMOS transistor usually is 2:1. The reason for this is as follows: If the PMOS and NMOS transistors have gate widths of the same size, the ON resistance of the PMOS transistor will be twice that of the NMOS transistor. In order to equalize the ON resistances of the two transistors, therefore, it is necessary that size ratio be made 2:1. By equalizing the ON resistances, the threshold voltage of the inverter becomes half the power-supply voltage (Vdd). This is the expedient usually employed to equalize and hence avoid the effects of noise from the side of the power supply and from the side of ground.

However, owing to the higher speed and much smaller design rule of the heater drive circuit and external signal processing circuit, there is a tendency to adopt a lower voltage for the power-supply voltage Vdd of the logic circuit, and it is predicted that the present 5V will soon be replaced by a voltage of 3.3V.

If in such case the threshold voltage of the initial inverter of the voltage converting circuit is kept at the present 3 to 4V, it is conceivable that an inversion will not be performed satisfactorily or that the inversion voltage will not be reached with a logic-signal voltage of 3.3V, as illustrated in FIG. 8. If the initial inverter cannot perform the inversion satisfactorily, there is a possibility that the driving capability of the inverter of the next stage will decline as well as the switching speed.

Owing to the phenomena mentioned above, there is the likelihood that the pulse width of the heater drive signal will vary, making it impossible to implement heater drive normally. If a voltage at which an inversion is possible is not reached, the logic signal may not be transmitted to the next stage. Such an occurrence may make it impossible to achieve heater drive itself.

Furthermore, if the ratio of the gate width W1 of the PMOS transistor to the gate width W2 of the NMOS transistor in the conventional inverter is set to 2:1, as shown in FIG. 9, the threshold voltage of the inverter will be ½ Vdd. If the power-supply voltage VHT of the voltage converting circuit is set to 8V, therefore, then the threshold voltage of the initial inverter stage becomes 4V and, as a consequence, the signal is not transmitted to the next stage.

The present invention has been devised in view of the above-described circumstances and its object is to provide a substrate for a printhead, the printhead per se and a printing apparatus, in which even if the voltage of the logic signal is below 3.3V, the threshold voltage of the initial inverter of the voltage converting circuit can be set to a level at which an inversion can be performed satisfactorily.

Furthermore, in recent printheads and printers that use these printheads, there is a growing tendency to adopt a lower voltage for the logic signal voltage owing to the higher speed and much smaller design rule of the heater drive circuit and external signal processing circuit, such as a CPU. The present 5V is rapidly being replaced by 3.3V.

Furthermore, the use of lower voltage for the CPU is proceeding with the greater sophistication of the manufacturing process. For example, power-supply voltage in a case where use is made of a 0.5-$\mu$m rule process is on the order of 2.0V, and it is predicted that power-supply voltage in a case where use is made of a 0.15 to 0.18-$\mu$m rule process will be 1.5V or less. Equalizing the signal voltage of the external processing circuit and the logic-signal voltage within the head is vital for lowering the overall cost of the apparatus from the viewpoint of commonality. For this reason, the logic-signal voltage within the head is expected to decline in the future, from 3.3V to 2.0V to 1.5V and even lower. With the use of ever lower voltage, there is the possibility that malfunction will occur in the interface between the logic signal and the drive signal of the driver transistor. Accordingly, means for dealing with the lower voltage must be provided and it is also necessary to provide means for eliminating any problems. These are important and unique challenges confronted in the development of printheads.

SUMMARY OF THE INVENTION

Accordingly, in order to solve the aforementioned problems and attain the object of the present invention, there is provided a substrate for a printhead having a printing element for ejecting a printing agent, a logic circuit for accepting a logic signal from a transfer source, transistors for driving the printing element by the logic signal, and a voltage converting circuit, which has a plurality of inverters, disposed between gate electrodes of the transistors for converting the voltage of the logic signal, wherein a threshold voltage of an inverter provided at an initial stage of the voltage converting circuit is set to a voltage at which an inversion is possible below a power-supply voltage of the logic circuit, said voltage being lower than a threshold voltage of the other inverters.

A printhead according to the present invention comprises a printing element for ejecting a printing agent, a logic circuit for accepting a logic signal from a transfer source, transistors for driving the printing element by the logic signal, and a voltage converting circuit, which has a plurality of inverters, disposed between gate electrodes of the transistors for converting the voltage of the logic signal, wherein a threshold voltage of an inverter provided at an initial stage of the voltage converting circuit is set to a voltage at which an inversion is possible below a power-supply voltage of the logic circuit, said voltage being lower than a threshold voltage of the other inverters.

A printing apparatus according to the present invention is equipped with a printhead having a printing element for ejecting a printing agent, a logic circuit for accepting a logic signal from a transfer source, transistors for driving the printing element by the logic signal, and a voltage converting circuit, which has a plurality of inverters, disposed between gate electrodes of the transistors for converting the voltage of the logic signal, image data being printed on a printing medium while the logic signal is transferred to the printhead, wherein a threshold voltage of an inverter provided at an initial stage of the voltage converting circuit is set to a voltage at which an inversion is possible below a power-supply voltage of the logic circuit, said voltage being lower than a threshold voltage of the other inverters.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENTS

Embodiments in which a printing apparatus according to the present invention is applied to an ink-jet printer will now be described in detail with reference to the accompanying drawings.

GENERAL STRUCTURE OF THE PRINTING APPARATUS

Figure 1:
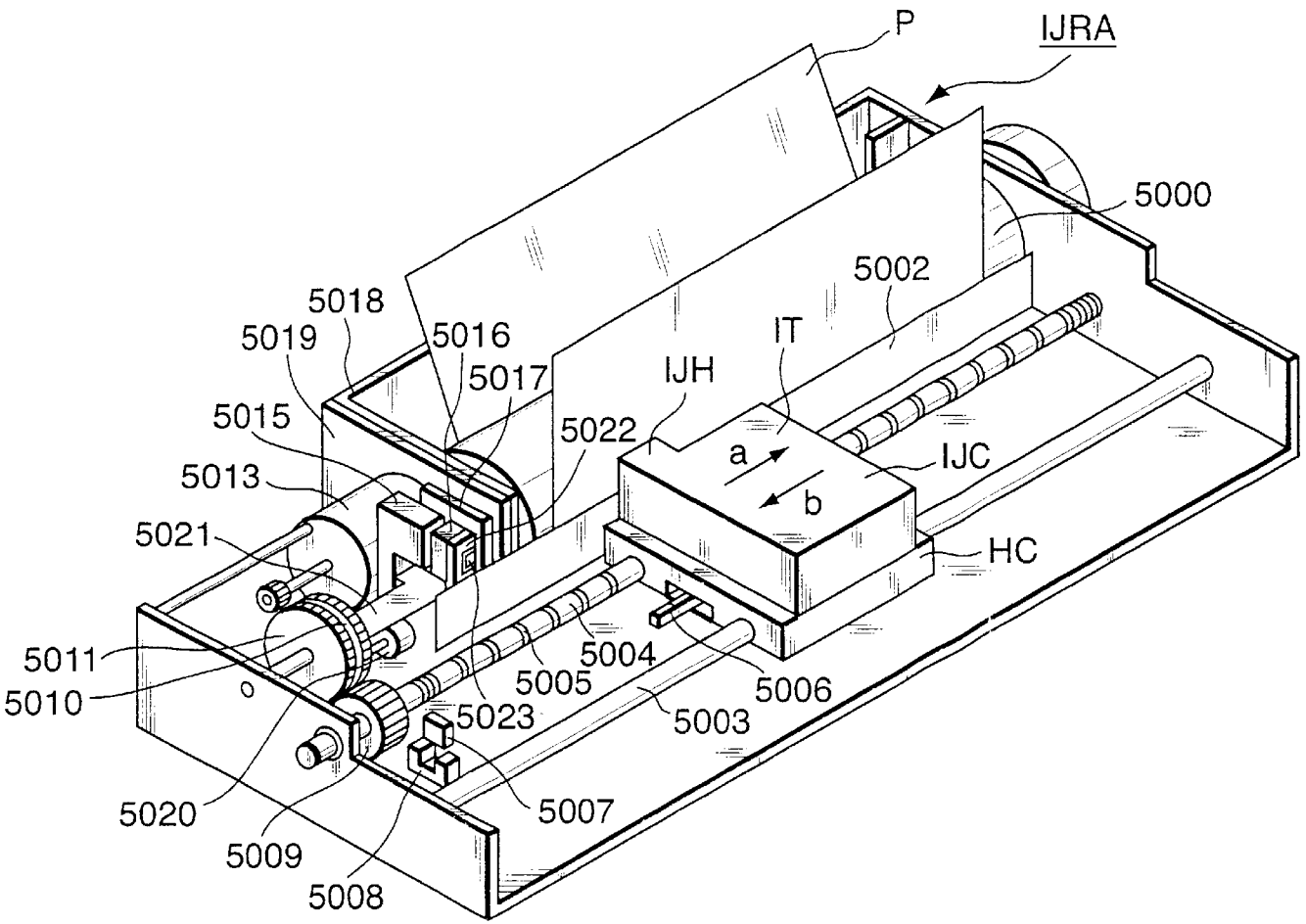
FIG. 1 is an external perspective view showing the structure of an ink-jet printer, which is a typical embodiment of the present invention.

FIG. 1 is an external perspective view showing the structure of an ink-jet printer IJRA, which is a typical embodiment of the present invention.

As shown in FIG. 1, a carriage HC is engaged with a helical groove 5004 of a lead screw 5005 rotated via driving force transmission gears 5009 to 5011 in operative association with the forward and reverse rotation of a driving motor 5013. The carriage HC, which has a pin (not shown), is moved back and forth in directions of arrows a and b. An ink-jet cartridge IJC is mounted on the carriage HC. Numeral 5002 denotes a paper retaining plate which presses printing paper P against a platen 5000 along the traveling direction of the carriage HC. Numerals 5007, 5508 denote photocouplers which constitute home position sensing means for verifying the presence of a carriage lever 5006 in the vicinity of the photocouplers and changing over the direction in which the motor 5013 is rotated. Numerals 5016 denote a member which supports a cap member 5022, which is for capping the front side of the printhead. Numeral 5015 denotes suction means for applying suction to the cap to subject the printhead to suction recovery via an opening 5023 inside the cap. Numeral 5019 denotes a member which makes it possible to move a cleaning blade 5017 back and forth. The cleaning blade 5017 and the member 5019 are supported on a support plate 5018. It goes without saying that the blade need not be of this type and that a well-known cleaning blade can be applied to this example. Further, numeral 5021 denotes a lever for starting the suction of the suction recovery operation. The lever moves with movement of a cam 5020 engaged with the carriage. Movement is controlled by well-known transfer means whereby the driving force from the driver motor is changed over as by a clutch.

The capping, cleaning and suction recovery operations are so arranged that the desired processing is performed at the corresponding positions by the action of the lead screw 5005 when the carriage arrives in an area on the home-position side. However, if it is so arranged that the desired operations are performed at well-known timings, this arrangement can also be applied to this example.

A control structure for controlling printing by the printing apparatus set forth above will now be described.

Figure 2:
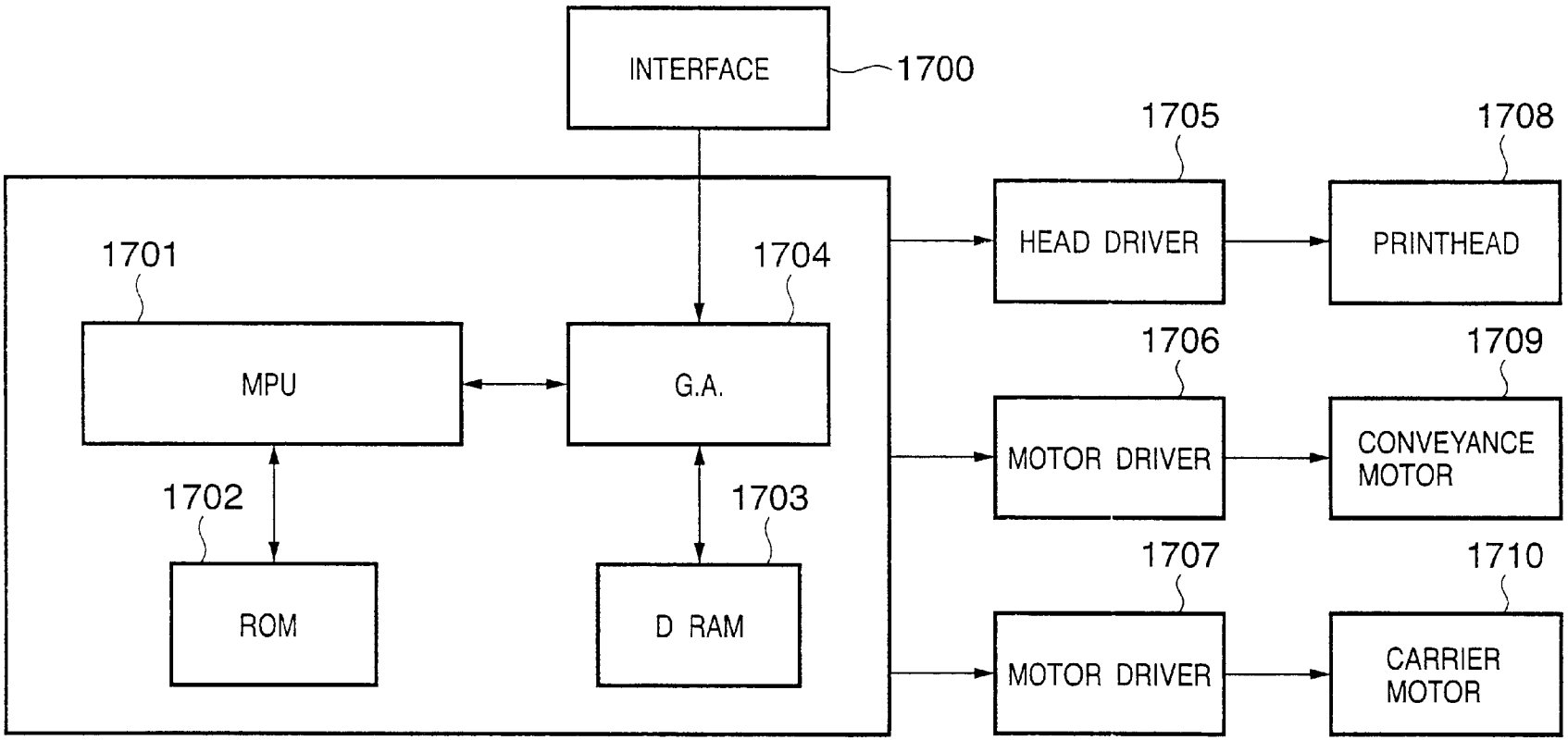
FIG. 2 is a block diagram illustrating the structure of control circuit of the ink-jet printer shown in FIG. 1.

FIG. 2 is a block diagram illustrating the structure of a control circuit for controlling the inkjet printhead IJRA. The control circuit includes an interface 1700 for entering a print signal, an MPU 1701, a program ROM 1702 for storing a control program executed by the MPU 1701, a DRAM 1703 in which various data (the above-mentioned print signal as well as print data supplied to the printhead) is saved, and a gate array (GA) 1704 for controlling supply of print data to a printhead 1708 and for controlling transfer of data between the interface 1700 and MPU 1701 and RAM 1703. A carrier motor 1710 transports the printhead 1708, and a conveyance motor 1709 conveys printing paper. A head driver 1705 drives the printhead, and motor drivers 1706, 1707 drive the conveyance motor 1709 and carrier motor 1710, respectively.

Operation of the control structure is as follows: When a print signal enters the interface 1700, the gate array 1704 and MPU 1701 cooperate to convert the print signal to print data for printing. The motor drivers 1706, 1707 are driven so that the printhead is actuated and performs printing in accordance with the print data sent to the head driver 1705.

Structure of the Printhead Drive Circuit

Figure 3A:
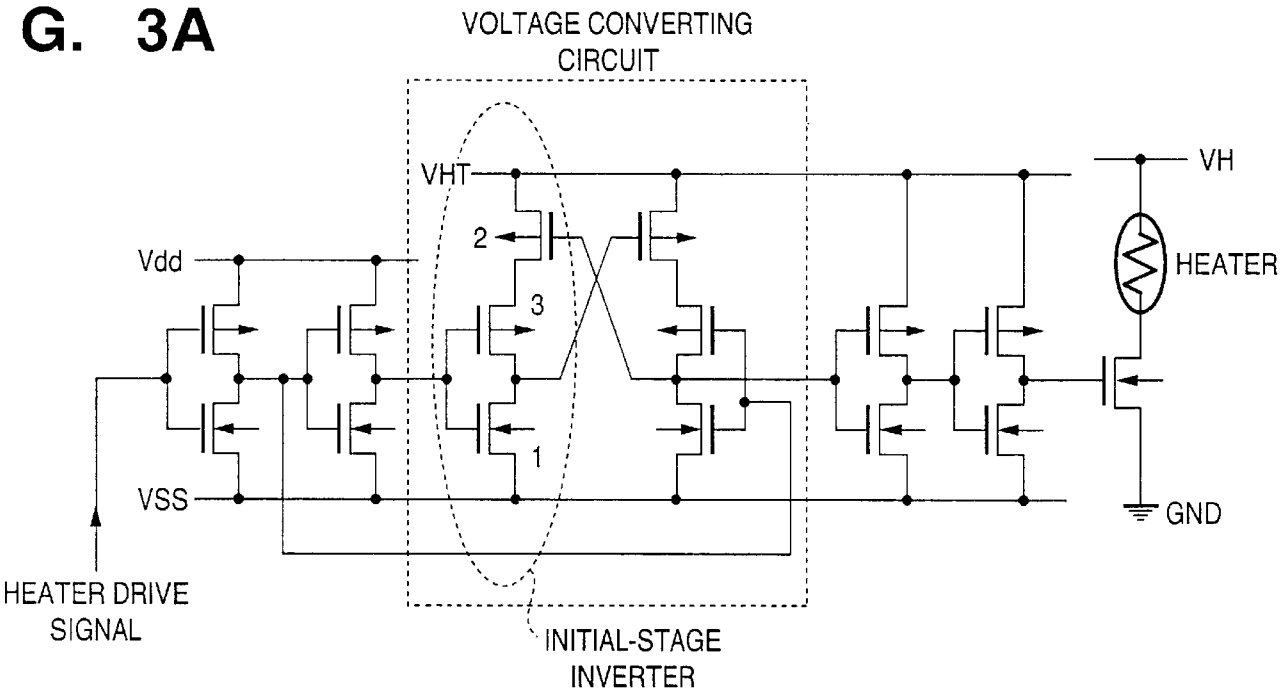
FIG. 3A is a diagram showing a thermoelectric transducer and the structure of its drive circuit in the printhead of a first embodiment.

FIG. 3A is a diagram showing a thermoelectric transducer and the structure of its drive circuit in the printhead of a first embodiment. Here the gate-width ratio between a NMOS transistor 1 and PMOS transistors 2, 3 constructing the initial inverter stage of a voltage converting circuit is set in such a manner that the threshold voltage will become a voltage less than the power-supply voltage Vdd (3.3V) of the logic circuit or a voltage at which an inversion can be performed satisfactorily.

Figure 3B:
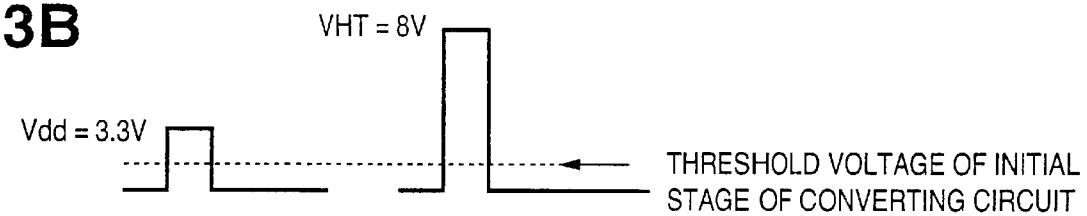
FIG. 3B is a diagram useful in describing the threshold voltage of an initial-stage inverter in the drive circuit of the thermoelectric transducer in the printhead of the first embodiment.

More specifically, as shown in FIG. 3B, the gate-width ratio is set in such a manner that the threshold voltage of the initial inverter becomes a voltage at which inversion is possible, this voltage being less than one-half the power-supply voltage VHT (8V) of the voltage converting circuit and, moreover, less than the power-supply voltage Vdd of the logic circuit.

Specifically, the threshold voltage of the initial inverter can be made less than half the converter voltage by making the gate width of the NMOS transistor 1 larger than the gate width of the PMOS transistors 2, 3 (gate length, represented by L, is identical) to thereby lower the ON resistance of the NMOS transistor 1. For example, if gate size W/L of the PMOS transistors 2, 3 is made 6 $\mu$m/3 $\mu$m and gate size W/L of the NMOS transistor 1 is made 10 $\mu$m/3 $\mu$m in FIG. 3A, then the threshold voltage can be set to 1.6 to 1.8V. As a result, the initial inverter is capable of performing an inversion satisfactorily with a voltage Vdd of 3.3V.

It should be noted that the method described above is one in which the ON resistance is changed by changing the gate width W. However, the same effects are obtained by changing the ratio of the ON resistances by changing the gate length L or the ratio of the gate sizes W/L.

Figure 4:
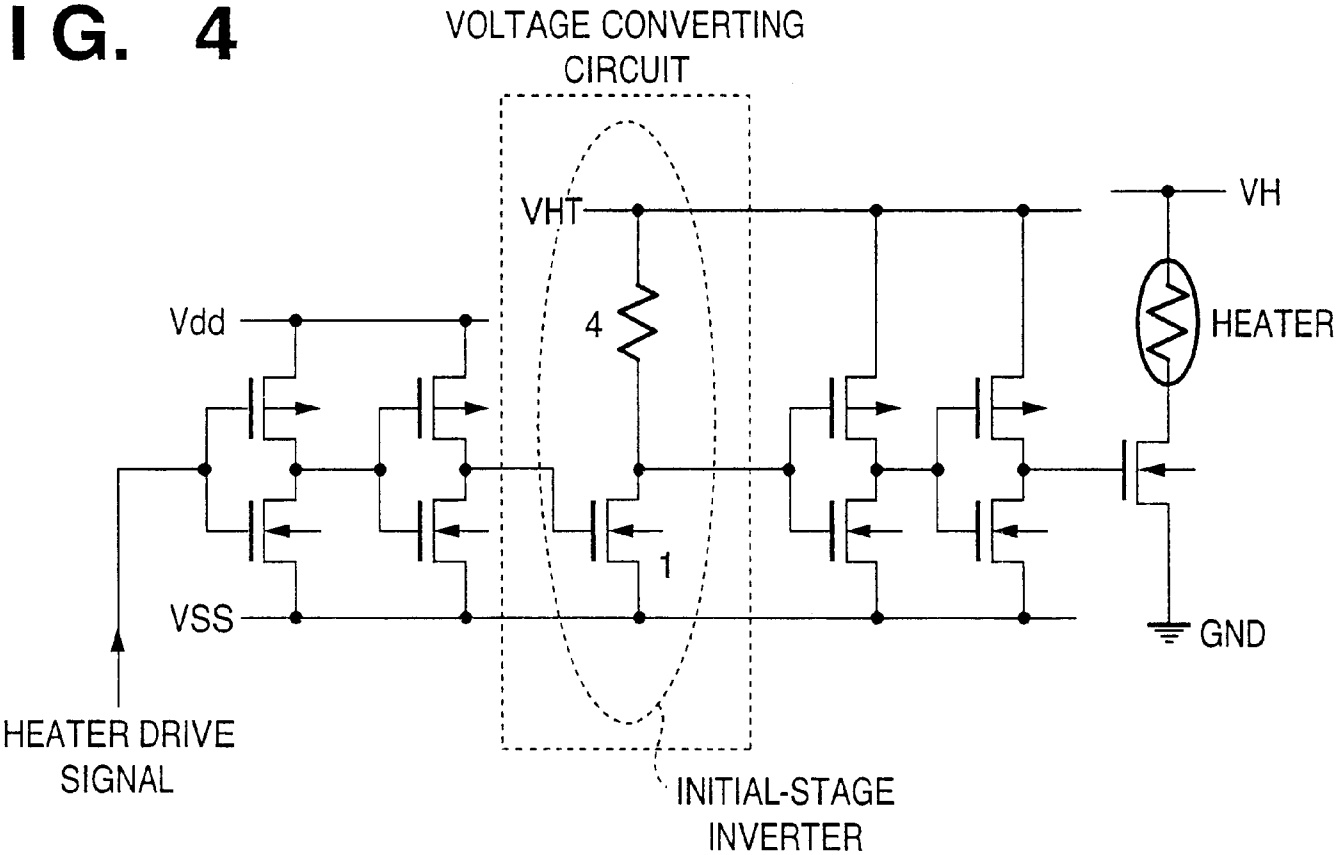
FIG. 4 is a diagram showing a thermoelectric transducer and the structure of its drive circuit in the printhead of a second embodiment.

FIG. 4 is a diagram showing a thermoelectric transducer and the structure of its drive circuit in the printhead of a second embodiment. Here the resistance ratio between the NMOS transistor 1 and a load transistor 4 constructing the initial inverter stage of a voltage converting circuit is set in such a manner that the threshold voltage will become a voltage less than the power-supply voltage Vdd (3.3V) of the logic circuit or a voltage at which an inversion can be performed satisfactorily. More specifically, as shown in FIG. 3B, the ratio is set in such a manner that the threshold voltage of the initial inverter becomes a voltage at which inversion is possible, this voltage being than one-half the power-supply voltage VHT (8V) of the voltage converting circuit and, moreover, less than the power-supply voltage of the logic circuit.

Specifically, the threshold voltage of the initial inverter can be made less than half the converter voltage by setting the ON resistance of the NMOS transistor 1 to a value smaller than the resistance value of the load resistor 4. For example, in a case where the resistance value of the load resistor 4 is 20 kΩ in FIG. 4, the threshold voltage can be set to 1.6 to 1.8V if the gate size W/L of the NMOS transistor 1 is in made 28 $\mu$m/3.5 $\mu$m. As a result, the initial inverter is capable of performing an inversion satisfactorily with a voltage Vdd of 3.3V.

It should be noted that the method described above is one in which the ON resistance is changed by changing the gate size W/L of the NMOS transistor 1. However, the same effects are obtained by changing only the gate length L or only the gate width W or by enlarging the resistance value of the load resistor 4.

Figure 5:
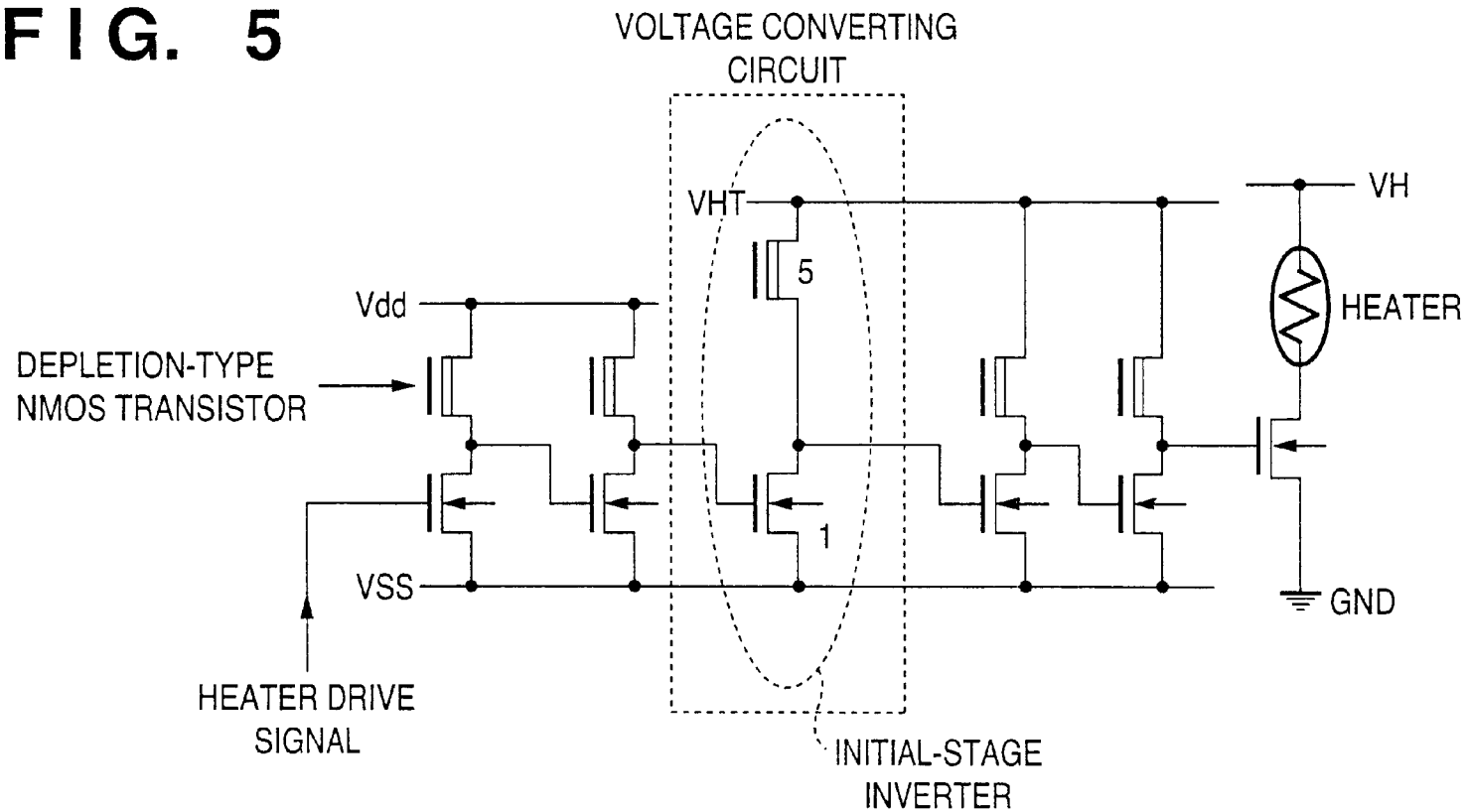
FIG. 5 is a diagram showing a thermoelectric transducer and the structure of its drive circuit in the printhead of a third embodiment.
Figure 6:
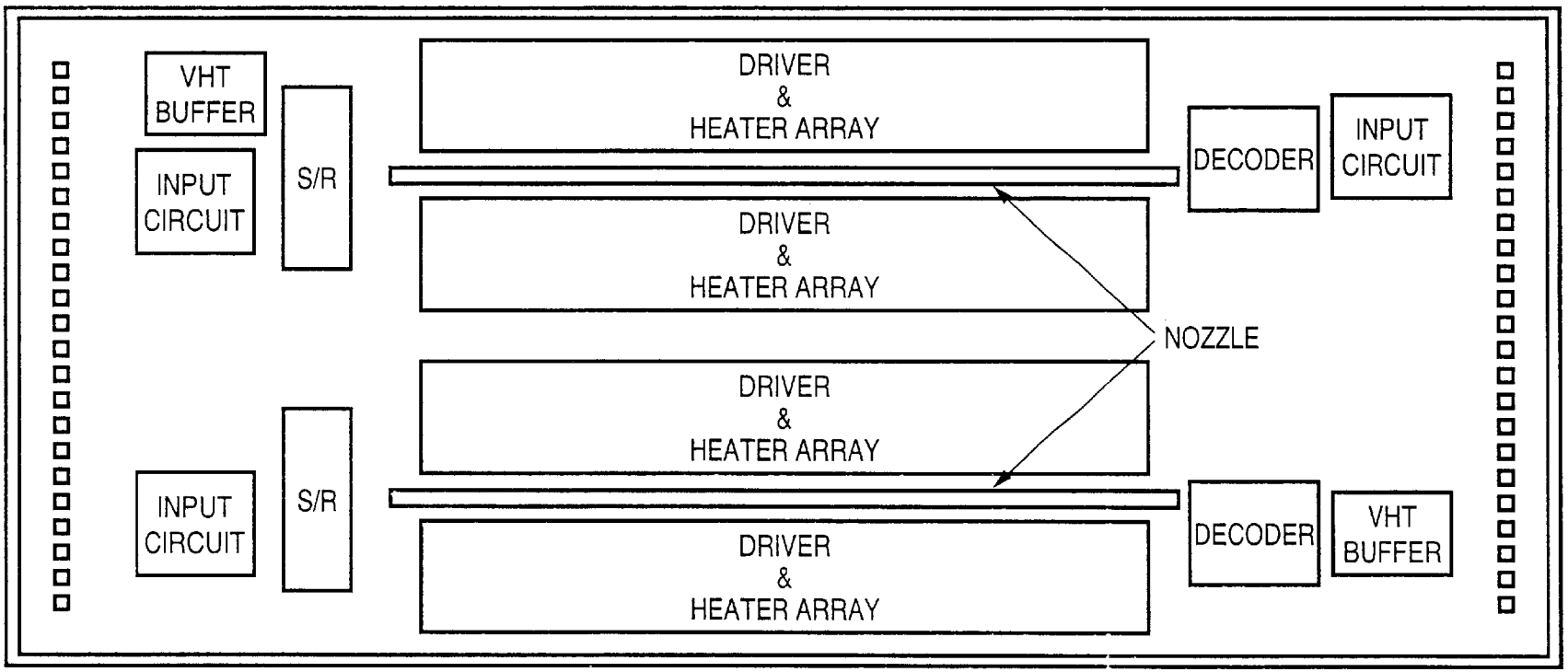
FIG. 6 is a diagram illustrating an example of a layout of heaters and heater drive circuits on a printhead substrate according to the prior art.
Figure 7A:
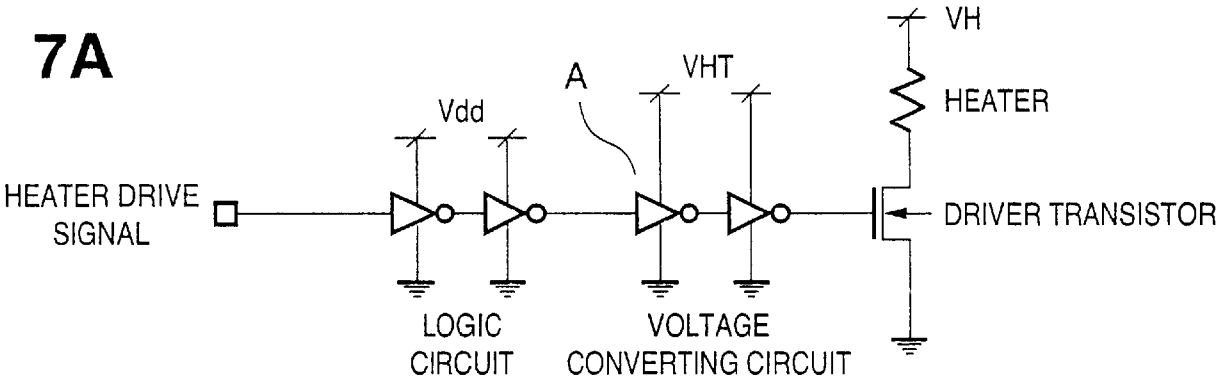
FIG. 7A is a diagram exemplifying a specific equivalent circuit corresponding to one segment of a portion in which heaters and driver transistors are disposed in the form of an array.
Figure 7B:
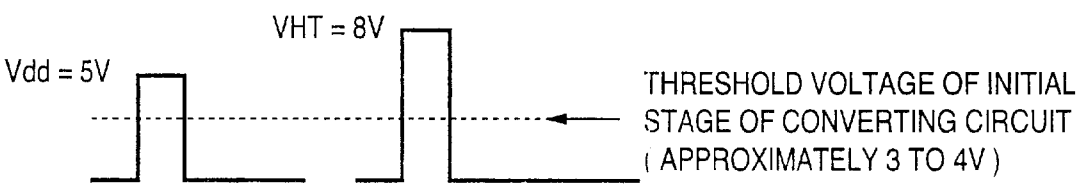
FIG. 7B is a diagram useful in describing the threshold voltage of an initial-stage inverter in the equivalent circuit of FIG. 7A.
Figure 8:
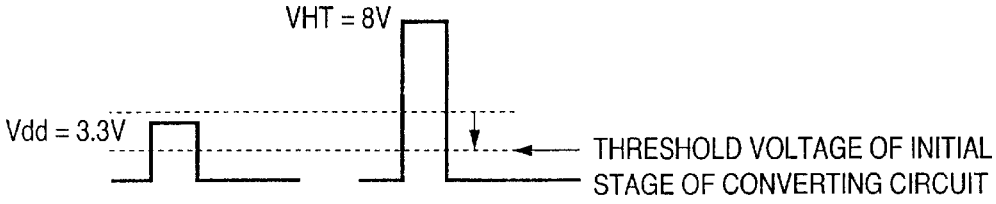
FIG. 8 is a diagram useful in describing the output state of a threshold voltage produced by a voltage converting circuit according to the present invention.
Figure 9:
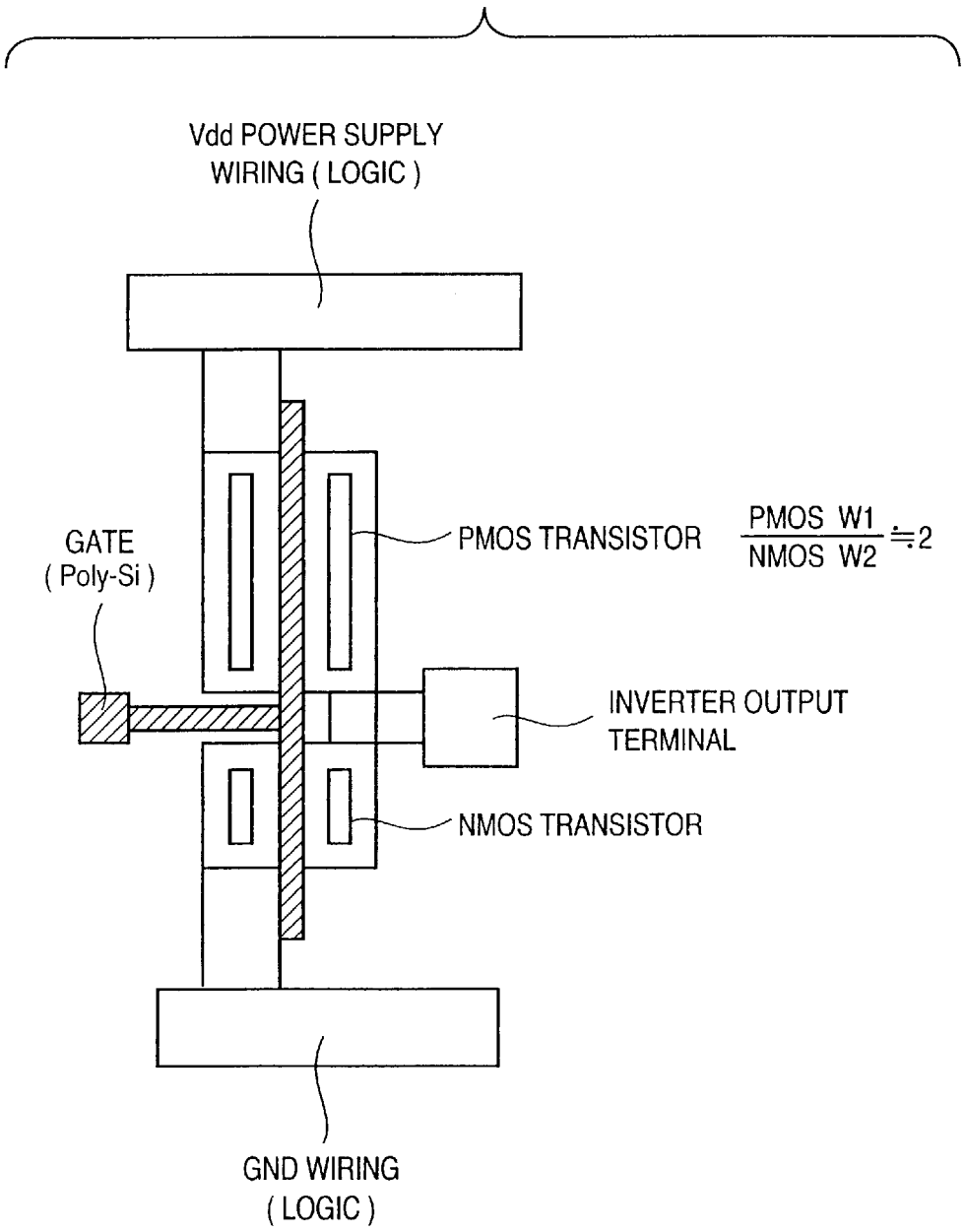
FIG. 9 is a diagram illustrating an example of the arrangement of PMOS and NMOS transistors in a voltage converting circuit.

FIG. 5 is a diagram showing a thermoelectric transducer and the structure of its drive circuit in the printhead of a third embodiment. Here the gate-width ratio between the NMOS transistor 1 and a depletion-type NMOS transistor 5, which serves as a load, constructing the initial inverter stage of a voltage converting circuit is set in such a manner that the threshold voltage will become a voltage less than the power-supply voltage Vdd (3.3V) of the logic circuit or a voltage at which an inversion can be performed satisfactorily. More specifically, as shown in FIG. 3B, the ratio is set in such a manner that the threshold voltage of the initial inverter becomes a voltage at which inversion is possible, this voltage being less than one-half the power-supply voltage VHT (8V) of the voltage converting circuit and, moreover, less than the power-supply voltage of the logic circuit.

Specifically, the threshold voltage of the initial inverter can be made less than half the converter voltage by making the gate width W of the NMOS transistor 1 larger than the gate width of the depletion-type NMOS transistor 5 (gate length, represented by L, is identical) to thereby lower the ON resistance of the NMOS transistor 1. For example, if the gate size W/L of the depletion-type NMOS transistor 5 is made 8 $\mu$m/3 $\mu$m and gate size W/L of the NMOS transistor 1 is made 12 $\mu$m/3 $\mu$m in FIG. 5, then the threshold voltage can be set to 1.6 to 1.8V. As a result, the initial inverter is capable of performing an inversion satisfactorily with a voltage Vdd of 3.3V.

It should be noted that the method described above is one in which the ON resistance is changed by changing the gate width W. However, the same effects are obtained by changing the ratio of the ON resistances by changing the gate length L or the ratio of the gate sizes W/L.

It is also possible to adopt an arrangement other than those of the above embodiments. For example, based upon the combination of elements that construct the initial inverter, the combined resistance thereof is adjusted. By thus adjusting the combined resistance, it is possible to set the threshold voltage to a voltage less than the power-supply voltage Vdd of the logic circuit or to a voltage at which an inversion can be performed satisfactorily.

In the foregoing embodiments, it is assumed that the liquid ejected from the printhead driven by printing elements is ink, and that the liquid contained in the ink tank is ink. However, the content of the tank is not limited to ink. For example, in order to improve the fixation or water resistance of a printed image and raise the quality of the image, a substance such as a treating solution ejected toward the printing medium may be accommodated in the ink tank.

The foregoing embodiments are described in regard to a printing apparatus, particularly of the ink-jet printing type, equipped with means (e.g., an electrothermal transducer or laser beam generator) for generating thermal energy as the energy utilized to discharge ink, wherein a change in the state of the ink is brought about by this thermal energy, thereby making it possible to achieve high-density, high-definition printing.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatus. Particularly, in the case of the on-demand type, at least one drive signal, which provides a sudden temperature rise that exceeds that for film boiling, is applied, in accordance with printing information, to an electrothermal transducer arranged to correspond to a sheet or liquid passageway holding a liquid (ink). As a result, thermal energy is produced in the electrothermal transducer to bring about film boiling on the thermal working surface of the printhead. Accordingly, air bubbles can be formed in the liquid (ink) in one-to-one correspondence with the drive signal. Owing to growth and contraction of the air bubbles, the liquid (ink) is ejected through an orifice so as to form at least one droplet. If the drive signal has the form of a pulse, growth and contraction of the air bubbles can be made to take place rapidly and in appropriate fashion. This is preferred since it will be possible to achieve liquid (ink) ejection exhibiting excellent response.

Signals described in the specifications of U.S. Pat. Nos. 4,463,359 and 4,345,262 are suitable as drive pulses having this pulse shape. It should be noted that even better printing can be performed by employing the conditions described in the specification of U.S. Pat. No. 4,313,124, which discloses an invention relating to the rate of increase in the temperature of the above-mentioned thermal working surface.

In addition to the combination of the orifices, fluid passageways and electrothermal transducers (in which the fluid passageway is linear or right-angled) disclosed as the construction of the printhead in each of the above-mentioned specifications, an arrangement using the art described in the specifications of U.S. Pat. Nos. 4,558,333 and 4,459,600, which disclose elements disposed in an area in which the thermal working portion is curved, may be employed. Further, it is possible to adopt an arrangement based upon Japanese Patent Application Laid-Open No. 59-123670, which discloses a configuration having a common slot for the ink ejecting portion of a plurality of electrothermal transducers, or Japanese Patent Application Laid-Open No. 59-138461, which discloses a configuration having openings made to correspond to the ink ejecting portions, wherein the openings absorb pressure waves of thermal energy.

As a printhead of the full-line type having a length corresponding to the maximum width of the printing medium capable of being printed on by the printing apparatus, use can be made of an arrangement in which the length is met by a combination of multiple printheads of the kind disclosed in the foregoing specifications, or an arrangement in which printheads serve as a single integrally formed printhead.

The printhead may be of the replaceable tip-type, in which the electrical connection to the apparatus proper and the supply of ink from the apparatus proper can be achieved by mounting the head on the apparatus proper, or of the cartridge type, in which the printhead itself is integrally provided with an ink tank, as described in the above embodiments.

In order to make the effects of printing much more stable, it is preferred that the printing apparatus described above be additionally provided with printhead recovery means and auxiliary means, etc. Specific examples are printhead capping means, cleaning means, pressurizing or suction means, and preheating means comprising an electrothermal transducer, a heating element separate from this transducer or a combination of the transducer and the heating element. A pre-ejection mode for performing ejection of ink independently of printing may also be provided. These expedients are effective in achieving stable printing.

Furthermore, the printing mode of the printing apparatus is not limited to one in which printing is performed using only a mainstream color such as black. The apparatus can be one which has at least a multiple-color mode in which printing is performed using multiple colors or a full-color mode in which printing is performed using mixed colors. This may be achieved by using an integrated printhead or by combining a plurality of printheads.

The embodiments set forth above are described on the assumption that ink is the fluid. The ink used may be one which solidifies at room temperature or lower, one which softens at room temperature or one which is a liquid at room temperature. In general, temperature control is performed in such a manner that ink viscosity will fall within a stable ink ejection range by adjusting the temperature of the ink itself so as to fall within a temperature range of no less than 30° C. to no greater than 70° C. Accordingly, it will suffice to use an ink liquefied when the printing signal is applied.

In order to positively prevent elevated temperature due to thermal energy by using this as the energy for converting the ink from the solid state to the liquid state, or in order to prevent evaporation of the ink, it is permissible to use an ink which solidifies when left standing but which is liquefied by application of heat. In any case, ink which is liquefied for the first time by thermal energy, such as an ink liquefied by application of thermal energy conforming to a printing signal and ejected as a liquid ink, or ink which has already begun to solidify at the moment it reaches the printing medium, can be applied to the present invention. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

A printing apparatus according to the present invention may take on a variety of forms. It may be provided as an integral part of or separate from an information processing device such as a computer and serve as the image output terminal thereof, as a copier apparatus in combination with a reader or the like, or as a facsimile machine having sending and receiving functions.

The present invention can be applied to a system constituted by a plurality of devices (e.g., a host computer, interface, reader, printer, etc.) or to an apparatus comprising a single device (e.g., a copier or facsimile machine, etc.).

Thus, in accordance with the embodiments of the invention as described above, the threshold voltage of the initial inverter stage of a voltage converting circuit can be set to a level at which an inversion can be performed satisfactorily, even if logic-signal voltage is less than 3.3V. As a result, signal transmission to successive gates can be performed smoothly without inviting any decline in switching speed.

As many apparently widely different embodiments of the present invention can be made without departing from the spirit and scope thereof, it is to be understood that the invention is not limited to the specific embodiments thereof except as defined in the appended claims.

What is claimed is:

1. A substrate for a printhead comprising:

a printing element for discharging ink and printing;

a logic circuit for outputting a logic signal for driving said printing element;

transistors for driving said printing element by a signal based on the logic signal outputted from said logic circuit; and a voltage converting circuit, which has a plurality of inverters disposed between said logic circuit and gate electrodes of said transistors, for converting the voltage of the logic signal by utilizing a predetermined power-supply voltage, wherein one of said plurality of inverters, which is provided at an initial stage of said voltage converting circuit, comprises a PMOS transistor and an NMOS transistor, and a transistor structure of said PMOS transistor and said NMOS transistor is adjusted in such a manner that the threshold voltage of said initial stage inverter becomes a voltage which is less than one-half the predetermined power-supply voltage and which is less than a power-supply voltage of the logic signal outputted from said logic circuit.

2. The substrate for the printhead according to claim 1, wherein the ratio of the gate width of said PMOS transistor to the gate width of said NMOS transistor is adjusted.

3. The substrate for the printhead according to claim 2, wherein the power-supply voltage of said logic circuit is less than 3.3V.

4. The substrate for the printhead according to claim 1, wherein said printhead is an ink-jet printhead for printing by utilizing thermal energy, said printhead having a thermal energy transducer for generating thermal energy applied to the ink.

5. The substrate for the printhead according to claim 1, wherein the threshold voltage of said initial stage inverter is lower than a threshold voltage of the other inverters.

6. A printhead comprising:

a printing element for discharging ink and printing;

a logic circuit for outputting a logic signal for driving said printing element;

transistors for driving said printing element by a signal based on the logic signal outputted from said logic circuit; and a voltage converting circuit, which has a plurality of inverters disposed between said logic circuit and gate electrodes of said transistors, for converting the voltage of the logic signal by utilizing a predetermined power-supply voltage, wherein one of said plurality of inverters, which is provided at an initial stage of said voltage converting circuit, comprises a PMOS transistor and an NMOS transistor, and a transistor structure of said PMOS transistor and said NMOS transistor is adjusted in such a manner that the threshold voltage of said initial stage inverter becomes a voltage which is less than one-half the predetermined power-supply voltage and which is less than a power-supply voltage of the logic signal outputted from said logic circuit.

7. The printhead according to claim 6, wherein the ratio of the gate width of said PMOS transistor to the gate width of said NMOS transistor is adjusted.

8. The printhead according to claim 7, wherein the power-supply voltage of said logic circuit is less than 3.3V.

9. The printhead according to claim 6, wherein said printing element is an electrothermal transducer for generating thermal energy necessary to eject the ink.

10. The printhead according to claim 6, wherein the threshold voltage of said initial stage inverter is lower than a threshold voltage of the other inverters.

11. A printing apparatus equipped with a printhead having a printing element for discharging ink and printing, a logic circuit for outputting a logic signal for driving said printing element, transistors for driving said printing element by a signal based on the logic signal outputted from said logic circuit, and a voltage converting circuit, which has a plurality of inverters disposed between said logic circuit and gate electrodes of said transistors, for converting the voltage of the logic signal by utilizing a predetermined power-supply voltage, image data being printed on a printing medium while the logic signal is transferred to said printhead, wherein one of said plurality of inverters, which is provided at an initial stage of said voltage converting circuit, comprises a PMOS transistor and an NMOS transistor, and a transistor structure of said PMOS transistor and said NMOS transistor is adjusted in such a manner that the threshold voltage of said initial stage inverter becomes a voltage which is less than one-half the predetermined power-supply voltage and which is less than a power-supply voltage of the logic signal outputted from said logic circuit.

12. The apparatus according to claim 11, wherein the ratio of the gate width of said PMOS transistor to the gate width of said NMOS transistor is adjusted.

13. The apparatus according to claim 12, wherein the power-supply voltage of said logic circuit is less than 3.3V.

14. The apparatus according to claim 11, wherein said printing element is an electrothermal transducer for generating thermal energy necessary to eject the ink.

15. The printing apparatus according to claim 11, wherein the threshold voltage of said initial stage inverter is lower than a threshold voltage of the other inverters.

16. A substrate for a printhead comprising:

a printing element for discharging ink and printing;

a logic circuit for outputting a logic signal for driving said printing element;

transistors for driving said printing element by a signal based on the logic signal outputted from said logic circuit; and a voltage converting circuit, which has a plurality of inverters disposed between said logic circuit and gate electrodes of said transistors, for converting the voltage of the logic signal by utilizing a predetermined power-supply voltage, one of said plurality of inverters, which is provided at an initial stage of said voltage converting circuit, comprising a PMOS transistor and an NMOS transistor, and a transistor structure of said PMOS transistor and said NMOS transistor being adjusted in such a manner that the threshold voltage of said initial stage inverter becomes a voltage which is less than one-half the predetermined power-supply voltage and which is less than a power-supply voltage of the logic signal outputted from said logic circuit.

17. The substrate for the printhead according to claim 16, wherein the threshold voltage of said initial stage inverter is lower than a threshold voltage of the other inverters.

18. A printhead comprising:

a printing element for discharging ink and printing;

a logic circuit for outputting a logic signal for driving said printing element;

transistors for driving said printing element by a signal based on the logic signal outputted from said logic circuit; and a voltage converting circuit, which has a plurality of inverters disposed between said logic circuit and gate electrodes of said transistors, for converting the voltage of the logic signal by utilizing a predetermined power-supply voltage, one of said plurality of inverters, which is provided at an initial stage of said voltage converting circuit, comprising a PMOS transistor and an NMOS transistor, and a transistor structure of said PMOS transistor and said NMOS transistor being adjusted in such a manner that the threshold voltage of said initial stage inverter becomes a voltage which is less than one-half the predetermined power-supply voltage and which is less than a power-supply voltage of the logic signal outputted from said logic circuit.

19. The printhead according to claim 18, wherein the threshold voltage of said initial stage inverter is lower than a threshold voltage of the other inverters.

20. A printing apparatus equipped with a printhead for printing image data on a printing medium by transferring a logic signal to said printhead, comprising:

a printing element for discharging ink and printing;

a logic circuit for outputting the logic signal for driving said printing element;

transistors for driving said printing element by a signal based on the logic signal outputted from said logic circuit; and a voltage converting circuit, which has a plurality of inverters disposed between said logic circuit and gate electrodes of said transistors, for converting the voltage of the logic signal by utilizing a predetermined power-supply voltage, one of said plurality of inverters, which is provided at an initial stage of said voltage converting circuit, comprising a PMOS transistor and an NMOS transistor, and a transistor structure of said PMOS transistor and said NMOS transistor being adjusted in such a manner that the threshold voltage of said initial stage inverter becomes a voltage which is less than one-half the predetermined power-supply voltage and which is less than a power-supply voltage of the logic signal outputted from said logic circuit.

21. The printing apparatus according to claim 20, wherein the threshold voltage of said initial stage inverter is lower than a threshold voltage of the other inverters.

* * * * *

UNITED STATES PATENT AND TRADEMARK OFFICE

CERTIFICATE OF CORRECTION

PATENT NO. : 6,712,437 B2
DATED : March 30, 2004
INVENTOR(S) : Tatsuo Furukawa et al.

It is certified that error appears in the above-identified patent and that said Letters Patent is hereby corrected as shown below:

Column 1,
Line 10, "and" (first occurrence) should be deleted;
Line 16, "Heater" should read -- The heater --;
Line 35, "set to" should be deleted;
Line 37, "as" should read -- at --;
Line 38, "is" should read -- is made --;
Line 43, "(W)" should read -- W1 --; and "width" should read -- width W2 --;
Line 44, "usually is" should read -- is usually --;
Line 49, "that" should read -- that the --;
Line 52, "equalize" should read -- equalize, --;
Line 53, "from" should read -- from, --; and
Line 54, "from" should be deleted.

Column 2,
Line 2, "stage will decline" should read -- stage, --;
Line 3, "speed." should read -- speed, will decline. --;
Line 16, "then" should be deleted;
Line 61, "transistors" should read -- transistors, --; and
Line 66, "said" should read -- the --.

Column 3,
Line 7, "sistors" should read -- sistors, --;
Line 11, "said" should read -- the --;
Line 19, "transistors" should read -- transistors, --;
Line 25, "said" should read -- the --;
Line 28, "shall" should read -- will --; and
Line 30, "to" should read -- to the --.

Column 4,
Line 26, "b." should read -- b along a guide rail 5003. --;
Line 30, "5508 denote" should read -- 5008 denote --;
Line 34, "Numerals" should read -- Numeral --; and
Line 35, "denote" should read -- denotes --.

Column 5,
Line 3, "RAM" should read -- DRAM --;
Line 38, "W/L" should read -- W/L (gate width/gate length) --;
Line 56, "circuit" should read -- circuit, --; and
Line 60, "being" should read -- being less --.

UNITED STATES PATENT AND TRADEMARK OFFICE

CERTIFICATE OF CORRECTION

PATENT NO. : 6,712,437 B2
DATED : March 30, 2004
INVENTOR(S) : Tatsuo Furukawa et al.

It is certified that error appears in the above-identified patent and that said Letters Patent is hereby corrected as shown below:

Column 6,
Line 21, "circuit" should read -- circuit, --;
Line 36, "8 $\mu$m/3 $\mu$m and" should read -- 8 $\mu$m/3 $\mu$m and the --; and
Line 52, "circuit" should read -- circuit, --.

Column 7,
Line 9, "apparatus." should read -- apparatuses. --;
Line 11, "that" (second occurrence) should read -- that required --; and
Line 35, "passageway is" should read -- passageways are --.

Column 8,
Line 17, "the" should read -- a --;
Line 25, "liquefied" should read -- which is liquefied --;
Line 60, "if" should read -- if the --; and
Line 62, "inviting" should read -- causing --.

Signed and Sealed this

Twenty-first Day of June, 2005

JON W. DUDAS
*Director of the United States Patent and Trademark Office*